US008773477B2

(12) United States Patent
Erinjippurath et al.

(10) Patent No.: US 8,773,477 B2
(45) Date of Patent: Jul. 8, 2014

(54) METHOD AND APPARATUS FOR EDGE LIT DISPLAYS

(75) Inventors: Gopal Erinjippurath, San Francisco, CA (US); John Gilbert, Pacifica, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 966 days.

(21) Appl. No.: 12/882,825

(22) Filed: Sep. 15, 2010

(65) Prior Publication Data

US 2012/0062607 A1 Mar. 15, 2012

(51) Int. Cl.

| | |
|---|---|
| ***G09G 5/10*** | (2006.01) |
| ***G09G 3/34*** | (2006.01) |
| ***H05B 41/36*** | (2006.01) |
| *G09G 3/00* | (2006.01) |
| *G09G 5/02* | (2006.01) |

(52) U.S. Cl.

CPC ..... *G09G 3/3413* (2013.01); *G09G 2320/0238* (2013.01); *G09G 2320/0242* (2013.01); *G09G 3/003* (2013.01); *G09G 3/342* (2013.01); *G09G 2320/0233* (2013.01); *G09G 5/026* (2013.01)

USPC ..... 345/690; 345/84; 315/294

(58) Field of Classification Search

USPC ..... 345/690, 84–104; 315/294

See application file for complete search history.

(56) References Cited

U.S. PATENT DOCUMENTS

| | | | | |
|---|---|---|---|---|
| 5,341,231 | A | 8/1994 | Yamamoto | |
| 5,537,233 | A | 7/1996 | Miura | |
| 6,535,190 | B2 * | 3/2003 | Evanicky | 345/88 |
| 6,891,672 | B2 | 5/2005 | Whitehead | |
| 6,977,766 | B2 | 12/2005 | Stevens | |
| 7,277,609 | B2 | 10/2007 | Cassarly | |
| 7,366,393 | B2 | 4/2008 | Cassarly | |
| 2005/0073495 | A1 | 4/2005 | Harbers | |
| 2005/0083274 | A1 | 4/2005 | Beddes | |
| 2005/0248520 | A1 | 11/2005 | Feng | |
| 2006/0221044 | A1 | 10/2006 | Negley | |
| 2007/0019129 | A1 | 1/2007 | Negley | |
| 2007/0047261 | A1 * | 3/2007 | Thompson et al. | 362/623 |
| 2007/0145914 | A1 | 6/2007 | Hong | |
| 2007/0242028 | A1 * | 10/2007 | Kitagawa et al. | 345/100 |
| 2007/0280593 | A1 | 12/2007 | Brychell | |
| 2008/0074060 | A1 | 3/2008 | Ye | |
| 2008/0088649 | A1 | 4/2008 | Ikeno | |
| 2008/0158245 | A1 | 7/2008 | Lieb | |

(Continued)

FOREIGN PATENT DOCUMENTS

| | | |
|---|---|---|
| DE | 102007045560 | 4/2009 |
| JP | 2009-224138 | 10/2009 |

(Continued)

*Primary Examiner* — Kent Chang
*Assistant Examiner* — Scott Au
(74) *Attorney, Agent, or Firm* — John W. Carpenter

(57) ABSTRACT

Edge lit displays are lit via a set (or individual) lighting elements. Each element projects light onto, for example, a zone which is then utilized directed as a backlight toward an LCD panel. An amount of light incident on any area (e.g., pixel) of the LCD panel (or SLM/series of SLMs) is calculated based on a sum of contributions from each zone. A similar process may be utilized for other lighting configurations. An amount of modulation performed by the LCD panel is then calculated based at least in part on lighting from the zones which may include brightness and varying levels of color content.

29 Claims, 8 Drawing Sheets

(56) References Cited

U.S. PATENT DOCUMENTS

| | | | | |
|---|---|---|---|---|
| 2009/0147186 | A1* | 6/2009 | Nakai et al. | 349/74 |
| 2010/0002465 | A1* | 1/2010 | Tsang et al. | 362/612 |
| 2010/0020008 | A1 | 1/2010 | Kobayashi | |
| 2010/0052552 | A1 | 3/2010 | Kimura | |
| 2010/0079703 | A1 | 4/2010 | Chung | |
| 2011/0157242 | A1* | 6/2011 | Wang | 345/690 |

FOREIGN PATENT DOCUMENTS

| | | |
|---|---|---|
| WO | 2004079437 | 9/2004 |
| WO | 2007002232 | 1/2007 |
| WO | 2008045200 | 4/2008 |
| WO | 2008144656 | 11/2008 |
| WO | 2008125926 | 12/2008 |
| WO | 2009008190 | 1/2009 |
| WO | 2010059568 | 5/2010 |

* cited by examiner

100

METHOD AND APPARATUS FOR EDGE LIT DISPLAYS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of Invention

The present invention relates to backlighting and modulation of displays. The invention is more particularly related to backlighting and modulation of edge-lit displays.

2. Discussion of Background

Typical direct backlight displays include a modulating panel such as an LCD panel that is directly illuminated by a light source (or sources) from behind the modulating panel. Edge-lit displays utilize light sources at an "edge" of a display and the light produced by the sources is then re-directed to the modulating panel.

Edge-lit displays are a popular choice for designers and consumers of today's LCDs. Accordingly, there are a number of patents and published patent applications relating to edge-lit displays, including, for example (each of which are hereby incorporated by reference for all purposes):

PCT/US2010/041105 entitled "Edge-Lit Local Dimming Displays, Display Components and Related Methods";

PCT Publication No. WO 2008/125926 entitled "Controllable Light-guide and Display Device";

PCT Publication No. WO 2008/045200 entitled "Optical Loss Structure Integrated in an Illumination Apparatus";

PCT Publication No. WO 2007/002232 entitled "Illumination Light Unit for Edge-lit Displays and System Using Same";

PCT Publication No. WO 2004/079437 entitled "A Display Device and an Illumination System Therefor";

U.S. Pat. No. 7,366,393 entitled "Light Enhancing Structures with Three or More Arrays of Elongate Features";

U.S. Pat. No. 7,277,609 entitled "Methods for Manipulating Light Extraction from a Light Guide";

U.S. Pat. No. 6,977,766 entitled "Display Device with Sideiluminated Cell";

U.S. Pat. No. 5,537,233 entitled "Direct-vision/projection Type Liquid-crystal Display Having Light Source at the Edge of a Gap Between Two Liquid Crystal Panels";

U.S. Pat. No. 5,341,231 entitled "Liquid Crystal Display Device with Edge Lit Lightguide Reflecting Light to Back Reflector by Total Internal Reflection"; and, U.S. Patent Application Publication No. US2007/0280593 entitled "High Contrast Edge-lit Signs and Images."

The advantages of edge-lit displays include that they can be produced having a thinner profile and may be more cost-efficient to produce than a direct-backlit display.

SUMMARY OF THE INVENTION

The present inventors have realized the need for improvements in backlit displays and particularly edge-lit and/or multi-modulated displays. In various embodiments, the present invention takes advantage of the edge-lit display's brightness and inherent power and cost efficiencies.

The technology described in this disclosure facilitates the development of better displays. For example, using zonal control of edge-lit displays can improve monitor display luminance and chromaticity uniformity. In another example, the present invention provides techniques to modulate edge-lit displays to achieve significantly improved contrast, and/or generally improve the light efficiency, and/or increase color control.

The present invention also provides zonal control configured to compensate for other optical elements placed in the light processing path for multi-modulated display systems. In various embodiments, the present invention provides for clustering of controllable light elements in a pre-determined fashion to create simplified light fields and allow for faster light field calculations.

In other embodiments, particularly with LCD modulation technology, which inherently have different transmission properties relative to viewing angles, the present invention can compensate for the differing properties via the use of light modulating techniques. And, dynamic backlight control may be used for accurate representation of the display in dynamically controlled reference luminance levels.

The present invention may be embodied as a method or device to implement any of the teachings above or described elsewhere herein. Portions of both the device and method may be conveniently implemented in programming on a general purpose computer, or networked computers, and the results may be displayed on an output device connected to any of the general purpose, networked computers, or transmitted to a remote device for output or display. In addition, any components of the present invention represented in a computer program, data sequences, and/or control signals may be embodied as an electronic signal broadcast (or transmitted) at any frequency in any medium including, but not limited to, wireless broadcasts, and transmissions over copper wire(s), fiber optic cable(s), and co-ax cable(s), etc.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
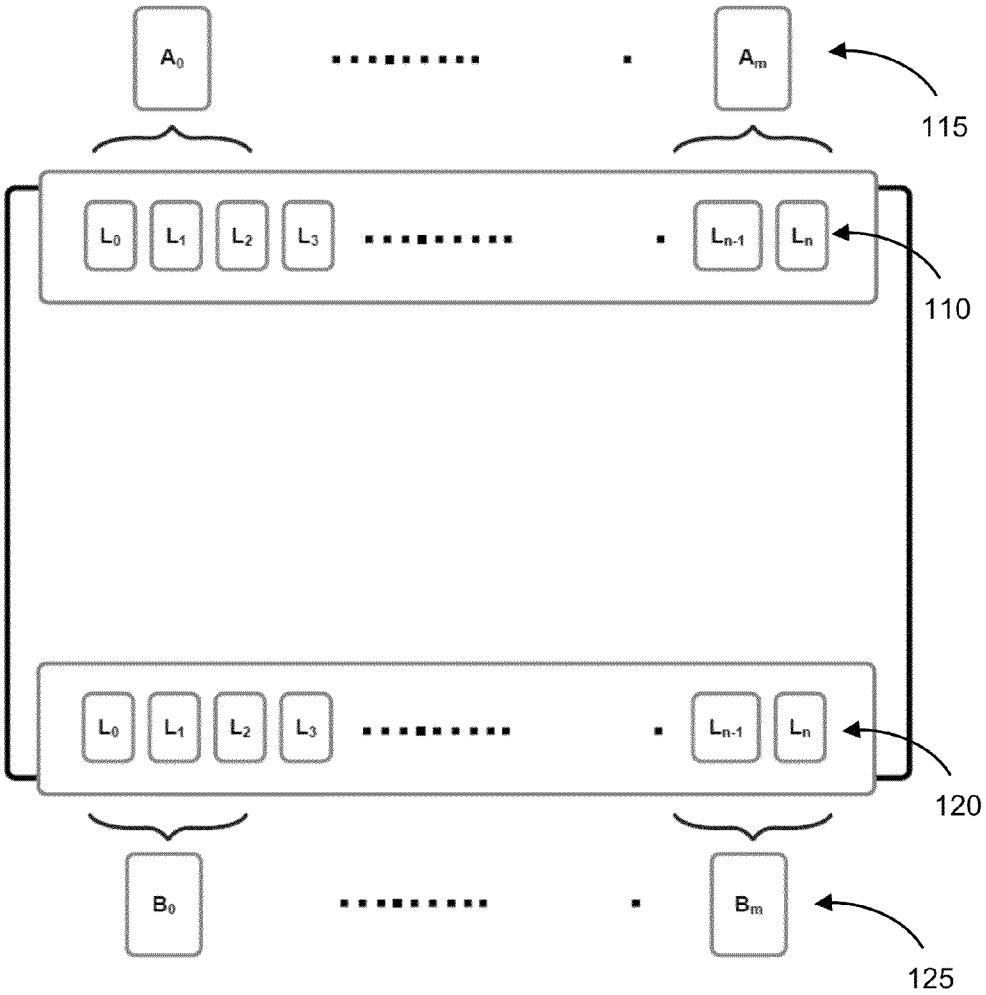
FIG. 1 is an illustration of an edge-lit display system with light sources controlled in groups according to an embodiment of the present invention.

Referring now to the drawings, wherein like reference numerals designate identical or corresponding parts, and more particularly to FIG. 1 thereof, there is illustrated an edge-lit display system 100 with light sources ($L_0$-$L_n$ 110 and $L_0$-$L_n$ 120) controlled in groups according to an embodiment of the present invention. The light source may be, for example, LEDs including tristimulus color primaries or white or both. The n LEDs may be controlled by m controllers. Preferably, m<n, but some designs, such as full locally controlled LEDs, m may equal n. In another design m=1, for example, where the LEDs are globally controlled, or a single controller provides multiple different drive levels to the various groups or the individual light sources.

As shown in FIG. 1, LEDs may be arranged in a first array of n light sources 110 on a top edge of the display system, and a second array of n light sources on a bottom edge of the display system. The number of the light sources and the positioning of the light sources within the array may be equivalent, but in some embodiments, the positioning may be staggered between the top and bottom edges. The arrangement of the light sources in any particular array need not be linear (e.g., the array may comprise a set of light sources where every other light source is positioned higher or lower than a previous light source in the array).

Although illustrated as having light source arrays along the horizontal edges of the display, a similar set of light source arrays and controllers may be alternately or additionally placed along the vertical edges. Staggering or alternate placement of light sources between opposing arrays (upper edge vs. lower edge) may also be interleaved with a staggering of left vertical edge vs. the right vertical edge.

M controllers may be provided to independently modulate clusters of the light sources/LEDs along the edges to demonstrate a zonal dimming effect. For example controllers $A_0$-$A_m$ 115 controller light sources (or clusters of light sources) along an upper edge of the display and controllers $B_0$-$B_m$ controlling light sources along a lower edge of the display.

The independent controllers may be used, for example, to control the color and brightness of specific regions on the front of the screen. Fine grained control of the LED clusters can be used to correct for minute variations in color and brightness across different regions at the front of the screen. Here, the regions are, for example, approximately the same size as a zone of illumination controlled by one cluster when projected or otherwise transmitted to LCD panel or front modulator(s). The corrections may be utilized, for example, to maintain constant color primaries (e.g., P3 or REC709) and/or constant white points (e.g., D65, D63). The combination of these controls allow for maintain control of color gamut (and/or other parameters of the light) over the entire screen (e.g., front panel or modulator(s)). For example, a constant color gamut may be maintained across the entire screen.

Figure 2:
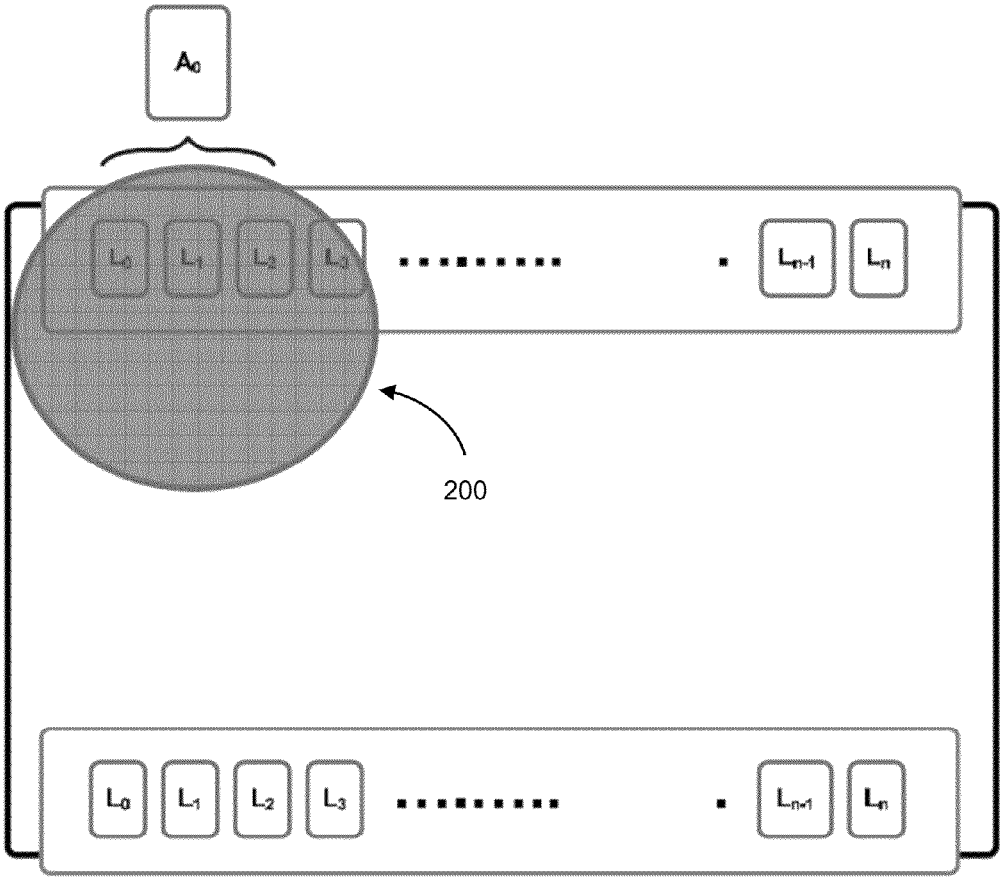
FIG. 2 is an illustration of a zone of illumination caused by a group of light sources according to an embodiment of the present invention.

FIG. 2 is an illustration of a zone of illumination (or zone) 200 caused by a group of light sources according to an embodiment of the present invention. Here the zone of illumination is caused by illumination from lighting elements (e.g., LEDs) $L_0$, $L_1$, and $L_2$ as controlled by controller $A_0$. The zone of illumination is produced by direct lighting and reflection from the aforementioned elements. The zone of illumination directly lights (and via reflection) optical elements such as a diffuser or collimator placed prior to a modulating panel such as an LCD panel. The diffuser may be for example a diffuser that is configured to be more receptive to the collection of parallel rays of light and dispersion of perpendicular rays of light than visa versa. In one embodiment, the diffuser is receptive to both parallel and perpendicular ray as light input and, however, mainly outputs light in perpendicular rays (or rays having greater intensity in a perpendicular direction away from the diffuser's downstream surface). The diffuser may be configured to homogenize but maintain the size and shape of the zone of illumination.

The modulating panel may comprise multiple levels of modulation and, in some cases, may comprise a series of LCD panels sandwiched closely together (e.g., back-to-back or interspersed between an optical stack which may include diffusers, polarizers (e.g., set-up polarizers and/or analyzing polarizers), and/or collimators). The modulating panels may be precisely aligned, slightly offset, or have different resolutions that are aligned via a repeating pattern or such that they are not readily aligned across the entire modulator or in a pattern. One modulating panel may include color filters (e.g., a typical LCD panel) and/or may be an LCD panel with the color filters removed or the display may be constructed with one of each.

In one embodiment, the modulating panel comprises two low resolution LCD panels placed on each side of an optical stack (e.g., diffuser, and/or polarizer, and/or collimator). In the diffuser embodiment, the diffuser may be for example, a diffuser with significantly less diffusion capability than the diffuser which is initially lit by the zone of illumination. Additional diffusers further in the optical change have similarly lower diffusion capability. Therefore, in one embodiment, each layer of diffusion from the zonal illumination to the last modulating panel has a differing amount of diffusion capability (each layer may have a decreased diffusion capability by, for example, 50%).

In one embodiment, the properties of the zones vary. For example, in one embodiment, a first set of zones may be illuminated with red, green, and blue light sources each having a portion of the red, green, and blue spectrums, and a second set of zones are illuminated with separate portions of the red, green, and blue spectrums. This may be utilized to illuminate a panel (or portions of a panel) with RGB lights in a first channel of 3D display and RGB lights of a second channel of the 3D display. The panel (or portions of the panel) illuminated by a first 3D channel illumination are energized to modulate the first channel image, and the panel (or portions of the panel illuminated by the second 3D channel illumination are energized to modulate the second channel image.

The above description can also be used for expanding the color gamut of the backlight. By using a combination of multiple bands in the visible Red, Green and Blue spectra for different LEDs, we can achieve a wider color for the backlight. This is a means to achieve a wider color edge-lit display.

In one 3D embodiment, at least one of the red, green, and blue spectrums (or channels of the 3D display) may be created using light sources including 2 separate light sources for a same color spectrum—the separate light sources producing light having different wavelength bands in the same color. For example, in the blue spectrum of one channel, the LEDs of one channel may produce both short and long wavelength blue light, and the LEDs of the other channel may produce blue in the mid-range of the blue wavelengths.

Low and high wavelength bands may be produced for one or all of the colors. The low and high blue wavelength bands and wavelength bands of the other channel (or any adjacent bands of different channels) may be separated by guard bands. The guard bands may be produced by non-production of light in those wavelengths or via filtering (e.g., a guard band filter layer placed between the light sources and, zones and/or between the light sources/zones and the downstream modulator(s), or between downstream modulators in a multi-modulator embodiment. Accordingly, in one 3D embodiment, guard bands between each of the channels are implemented by a single fixed filter configured to block any light produced in the guard bands (e.g., a filter that only blocks guard bands). In one embodiment, the present invention is a display using a guard band filter. In a 3D embodiment, the guard band filter is a 3D guard band filter that provides separation between the 3D channels (e.g., left and right eye channels) and, for example, blocks light not utilized in either channel. Using a guard band filter can be coupled with light sources (e.g. LEDs) which have a lower tolerance than embodiments not using the guard band filter, reducing the cost of the light sources.

The different spectrums are preferably produced by LEDs. In one embodiment, the LEDs are constructed using a UV light emitting source that energizes a phosphor or phosphors that emit light of a specific color/colors or wavelength ranges (e.g., red, green, or blue). In one embodiment, one of the LEDs used to illuminate a zone comprises a phosphor that emits blue light wavelengths. In another embodiment, one of the LEDs used to illuminate a zone comprises two phosphors which emit independent wavelength bands of light in a same color (e.g., of low blue wavelength band and a high blue wavelength band, where a mid range blue wavelength band is not produced or has a very low emission level).

In another embodiment, the LED contains 4 phosphors comprising a first color phosphor, a low band second color phosphor, a high band second color phosphor, and a third color phosphor. The second color may be red, green, or blue.

In yet another embodiment, the LED contains 5 phosphors comprising a low band first color phosphor, a high band first color phosphor, a low band second color phosphor, a high band second color phosphor, and a third color phosphor. In one embodiment, the first color is blue, the second color is green, and the third color is red. The high and low band emissions in a same color may be utilized in color correction between the 3D channels.

Whether used for 3D or 2D displays, by characterizing the LEDs and by characterizing the independently controlled clusters of LEDs, they may be modulated to create a locally dimmed display which achieves a much higher contrast ratio compared to existing edge-lit LED displays (e.g., a contrast ratio on the order of 10,000:1 and higher in a single image). This modulation can be based on the image to be projected on the display.

Accurately controlling a locally dimmed dual modulated system with edge-lit LEDs would require simulation of the back light. For a standard locally dimmed back-lit display (example: Dolby PRM4200, Brightside DR37), the light field is simulated as in Equation (1) and (2), for example, described in terms of tristimulus vectors, as provided in:

For each pixel vector r, the output tristimulus values can be computed as follows:

$$\begin{bmatrix} X(r) \\ Y(r) \\ Z(r) \end{bmatrix} = \sum_j \left( [P_j] \cdot PSF(r - r_j) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right) \quad (1)$$

where

X(r), Y(r), Z(r) are the tri-stimulus values target outputs in front of the display at a particular pixel position vector r.

$PSF(r-r_j)$ is the point spread function representing light from $j^{th}$ LED centered at pixel position $r_j$ shining through the pixel at position r.

$x_3$ is the desired light output from the $j^{th}$ LED.

$[P]_j$ is the tristimulus calibration matrix for the jth LED that the light from a particular tristimulus primary LED through a particular color LCD filter. For example, a system using R, G, B LEDs in the edgelit configuration, with R, G, B filters in the LCDs can be represented by a 3×3 calibration matrix.

$[X\ Y\ Z]_{j,min}$ represent the light leakage through the LCD (while turned off) due to $j^{th}$ LED at $r_j$ shining through the pixel at position r, and $P_R(r)$, $P_G(r)$, $P_B(r)$ are the linear color LCD drive values that we would compute to energize the pixels on the LCD panel.

We would solve for the linear LCD drive values as follows:

$$\begin{bmatrix} P_R(r) \\ P_G(r) \\ P_B(r) \end{bmatrix} = [T]^{-1} \left( \begin{bmatrix} X(r) \\ Y(r) \\ Z(r) \end{bmatrix} - \sum_j \left( \begin{bmatrix} X \\ Y \\ Z \end{bmatrix}_{j,min} \cdot PSF(r - r_j) \cdot x_j \right) \right) \quad (2)$$

where $$[T] = \sum_j [P_j] \cdot PSF(r - r_j) \cdot x_j \quad (3)$$

This equation takes into account the different drives for different LEDs. The computation may be performed by a microprocessor, ASIC, or EPROM or other computing mechanism. Other variations of the equations and associated programming may be made to account for other factors including varying gamut or other properties, and separate sets of equations may be provided for different lighting regimes, or sets of lighting regimes such as the two separate channels of 3D imagery. The above system of linear equations may be reused for an edge-lit LED display where the positions of the LEDs relative to the LCD pixels can be measured and factored into the equation in terms $r-r_j$. The result is the superposition of the light fields from all the different contributing light sources (e.g., LEDs) as illustrated in FIG. 3.

Figure 3:
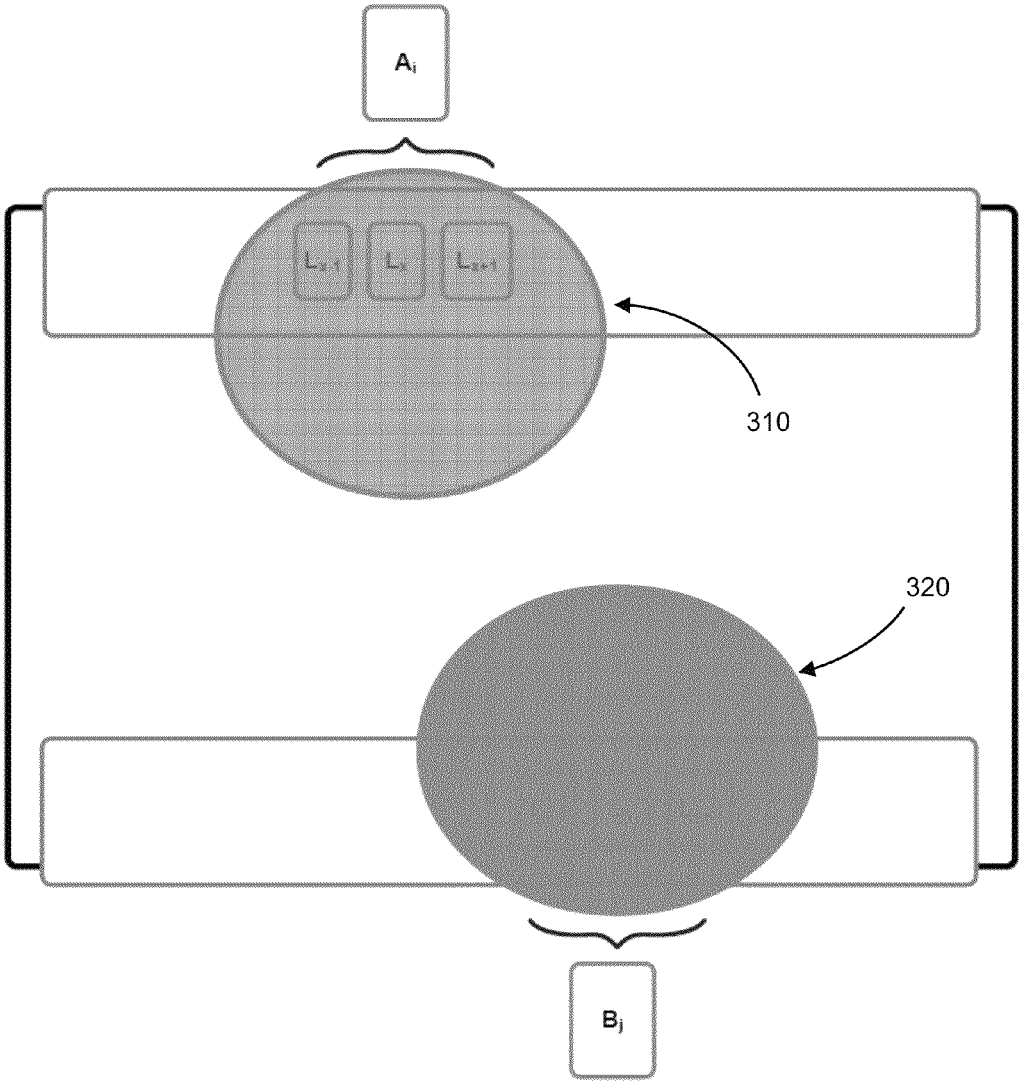
FIG. 3 is an illustration of a superposition of light fields from different contributing light sources according to an embodiment of the present invention.

FIG. 3 is an illustration of a superposition of light fields 310 and 320 from different contributing light sources according to an embodiment of the present invention. The zonal areas may have equivalent characteristics and similar or different illuminations (such as would likely occur for a local dimming embodiment and/or the combination of a local dimming and 3D embodiment). In the case of a 3D embodiment, the zones may have the same or different spectral characteristics.

Figure 4:
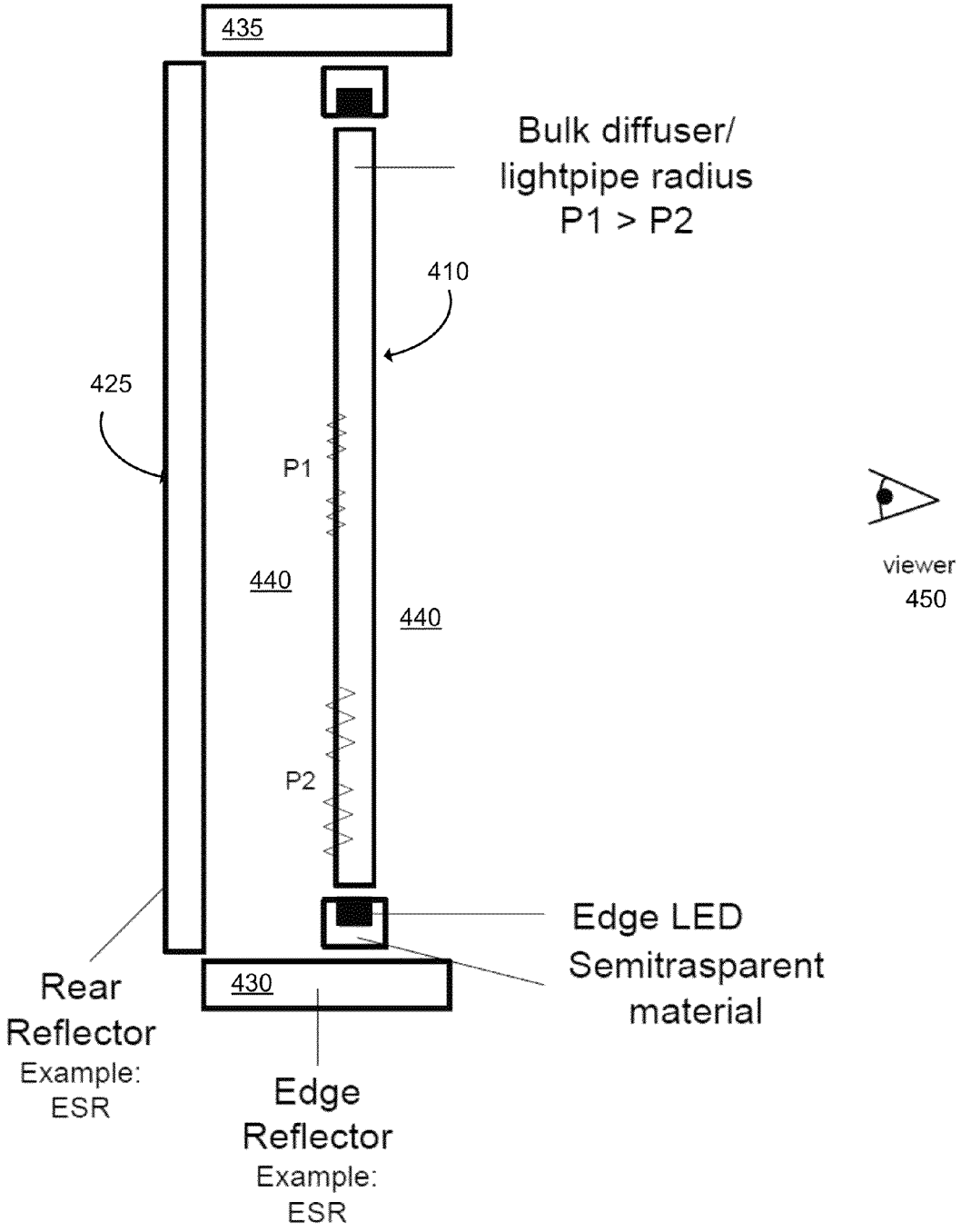
FIG. 4 is an illustration of an arrangement of a light pipe/waveguide and reflectors in an edge-lit display according to an embodiment of the present invention.

The present invention includes methods and apparatus to increase the light efficiency of an edge lit display. FIG. 4 is an illustration of an arrangement of a light pipe 410 and reflectors in an edge-lit display according to an embodiment of the present invention. The light pipe 410 comprises, for example, varying reflectance along its length (e.g., caused, for example, by a decreasing radius toward a central area of the light pipe) exemplified as reflectance P1 and reflectance P2. The varying reflectance allows light to be transported in the light pipe and then exiting toward a viewer 450 in controllable amounts along the length of the light pipe. The light pipe may be designed so that relatively equal amounts of light are emitted toward the viewer along the light pipe length.

In one embodiment, the amounts of light emitted toward a viewer along the light pipe's length are unequal to account for varying amounts of either one or more of direct light and/or reflectivity which may make greater or lesser contributions to a total amount of light emitted toward the viewer. Hence, the light pipe would then emit, for example, greater or lesser amounts of light to make the total amount of light emitted toward the viewer more uniform.

The light pipe is contained in an "optical cavity" 440 of the display which will likely be much less of a cavity than illustrated in FIG. 4. Using reflectors on the rear of the cavity (e.g., rear reflector 425) and edges of the bulk diffuser (e.g., edge reflectors 430/435), more light is "recycled" by causing more of the light to go through to the front of screen (or front modulator(s)). They reflectors may be, for example, an ESR (Enhanced Spectral Reflector) material or daylight film.

Figure 5:
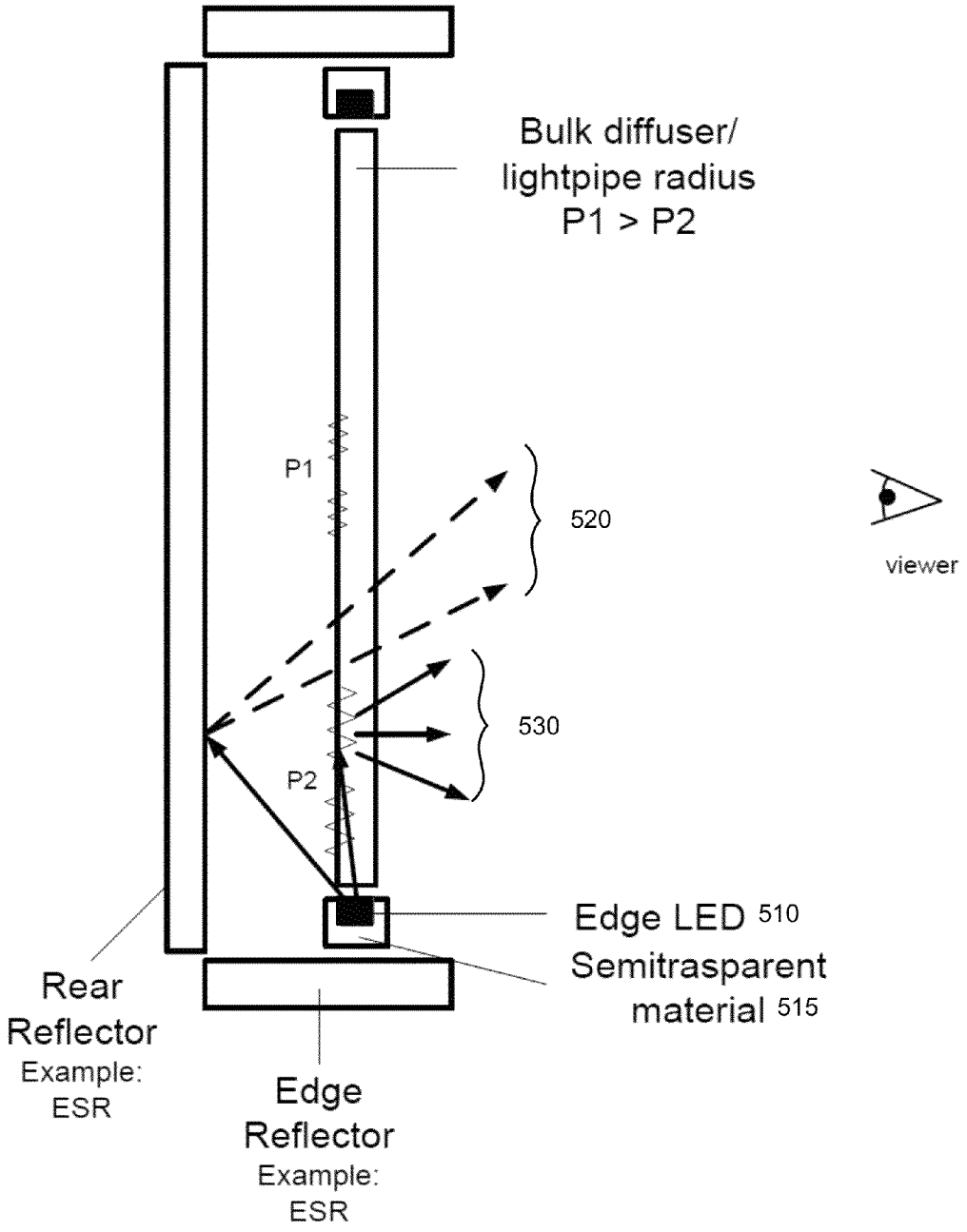
FIG. 5 is an illustration of a characterization of direct and reflected lights utilized according to various embodiments of the present invention.

The present invention also provides methods and apparatus to improve characterization performance of the edge-lit display for high contrast capability. FIG. 5 is an illustration of a characterization of direct and reflected lights utilized according to various embodiments of the present invention. By accurately modeling the direct and reflected light, a spatial reflectivity spread function may be accurately characterized for each of the LEDs (FIG. 5 is an example light ray model). In FIG. 5, a back side or rear reflector reflects light 520 from an edge light source 510, which may be an LED embedded in a semi-transparent material 515. Light from the same light source emitted through the light pipe is shown as 530.

In an edge lit display or display system, the computational algorithm or method preferably accounts for the reflectance of different or varying surrounding surfaces. Those reflective surfaces may include, for example, a back side of an optical cavity area behind the modulator(s), edges of the optical cavity, corners of the optical cavity, optical elements including any of optical sheets, films, or stacks within the cavity, or any device located in the optical path or otherwise affecting the optical path from the lighting sources to a modulation panel—in addition to the light received from, for example, the light pipe. In the case of multiple modulators, the computations may be performed separately or differently for each modulator. For each pixel vector r, output tristimulus values may be computed as follows:

In an edge-lit system, we would need account for the reflectance off the different surround surfaces. For each pixel vector r, the output tri-stimulus values can be computed as follows:

$$\begin{bmatrix} X(r) \\ Y(r) \\ Z(r) \end{bmatrix} = \sum_j \left( [P_j] \cdot PSF(r - r_j) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right) + \sum_j \left( [P]_j \cdot PSF(r - r_j) \cdot x_j \cdot R_j(r - r_j) \cdot \begin{bmatrix} P_R(r) \\ P_G(r) \\ P_B(r) \end{bmatrix} \right) \tag{4}$$

This can be reduced to:

$$\begin{bmatrix} X(r) \\ Y(r) \\ Z(r) \end{bmatrix} = \sum_j \left( [P]_j \cdot PSF(r - r_j) \cdot (1 + R_j(r - r_j)) \cdot x_j \cdot \begin{bmatrix} P_R(r) \\ P_G(r) \\ P_B(r) \end{bmatrix} \right) + \tag{5}$$

-continued $$\sum_j \left( \begin{bmatrix} X \\ Y \\ Z \end{bmatrix}_{j,min} \cdot PSF(r - r_j) \cdot x_j \right)$$

where

X(r), Y(r), Z(r) are the tri-stimulus values target outputs in front of the display at a particular pixel position vector r;

$PSF(r-r_j)$ is the point spread function representing light from $j^{th}$ LED centered at pixel position $r_j$ shining through the pixel at position r;

$x_j$ is the desired light output from the $j^{th}$ LED;

[P]j is the tristimulus calibration matrix for the jth LED that the light from a particular tristimulus primary LED through a particular color LCD filter. For example, a system using R, G, B LEDs in the edgelit configuration, with R, G, B filters in the LCDs can be represented by a 3×3 calibration matrix;

$[X\ Y\ Z]_{j,min}$ represent the light leakage through the LCD (while turned off) due to $j^{th}$ LED at $r_j$ shining through the pixel at position r;

$R_j(r-r_j)$ is the spatial reflectivity spread function (SRSF) representing light from the $j^{th}$ LED centered at position $r_j$ shining through the pixel at position r; and $P_R(r)$, $P_G(r)$, $P_B(r)$ are the linear color LCD drive values that we would compute to energize the pixels on the LCD panel. Although preferably calculated for each pixel, the tristimulus values may also be computed for groups or series of pixels.

The design described in (4) allows the LED backlight to be modulated based on the desired front of screen brightness. In a multi-modulated display system such as that described in Dolby Patent application reference number D10026, U.S. patent application Ser. No. 12/780,749, entitled "High Dynamic Range Displays Using Filterless LCDs For Increasing Contrast And Resolution," the contents of which are incorporated herein by reference for all purposes, teaches techniques of which could be used to improve the local contrast.

The present invention also provides for clustering controllable light elements in a pre-determined fashion to create simplified light fields. Lower complexity light fields allow for faster light field calculations.

Figure 6:
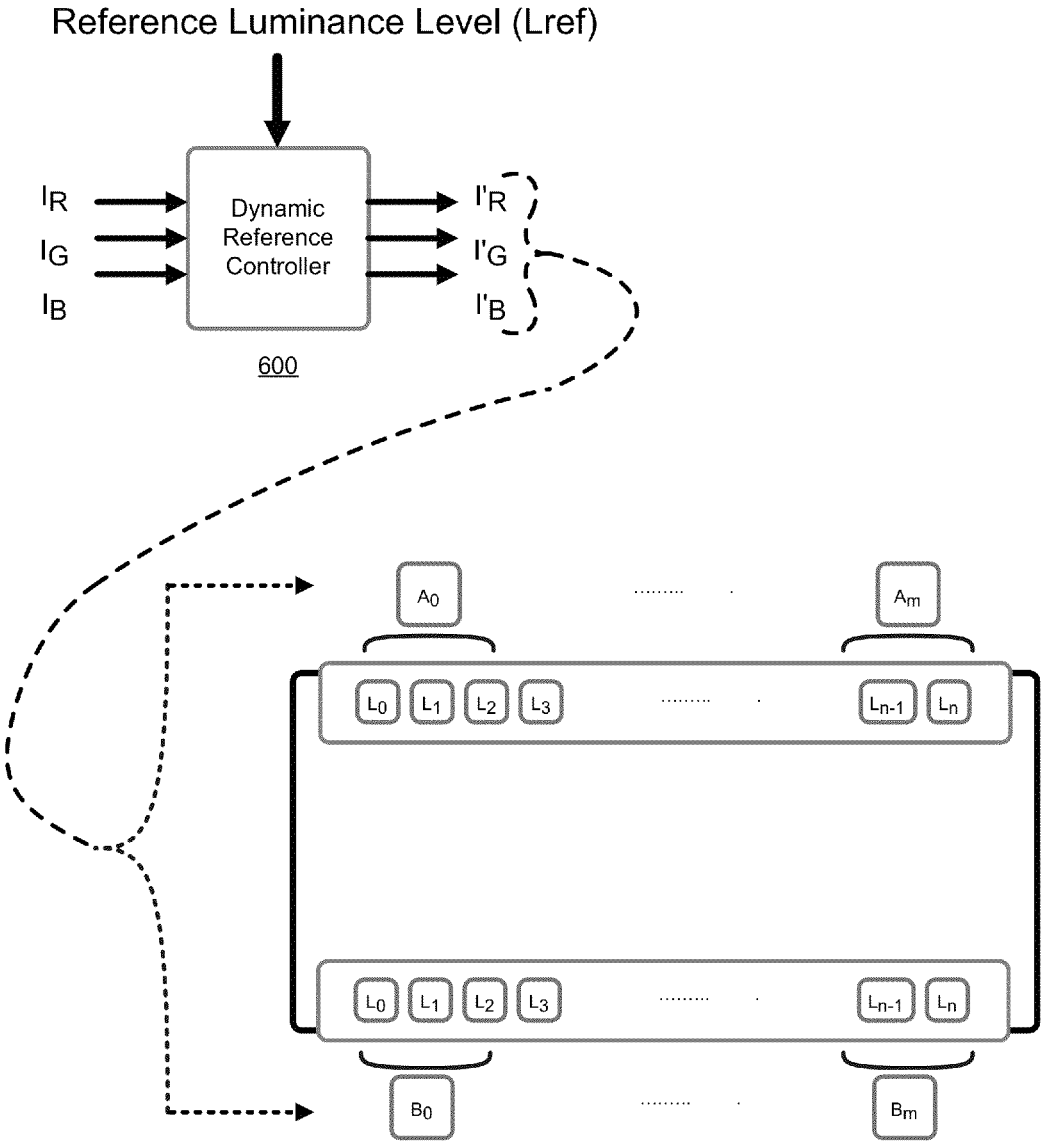
FIG. 6 is a schematic diagram of a dynamic reference luminance mode controller according to an embodiment of the present invention.

FIG. 6 is a schematic diagram of a controller 600 according to an embodiment of the present invention. The controller includes a circuit for dynamic backlight control for accurate representation of the display in a dynamic reference mode. The controller 600 has, for example, inputs for image data and a reference value. The current controls for the different tristimulus light sources $I_R$, $I_G$, and $I_B$ and input dynamic reference luminance level $L_{ref}$. The modified current controls based on the reference luminance levels are $I'_R$, $I'_G$, and $I'_B$, which are then utilized by one or more controllers to illuminate the light sources of each zone (e.g., controllers $A_0$-$A_m$ and $B_0$-$B_m$).

The designs described in this document can be used in conjunction with a backlight level controller to handle dynamic reference level for luminance. For example, by measuring and calibrating display, we can scale the output luminance to generate any reference luminance level which generate the output current drives $I'_R$, $I'_G$, and $I'_R$ as described in FIG. 6.

Figure 7:
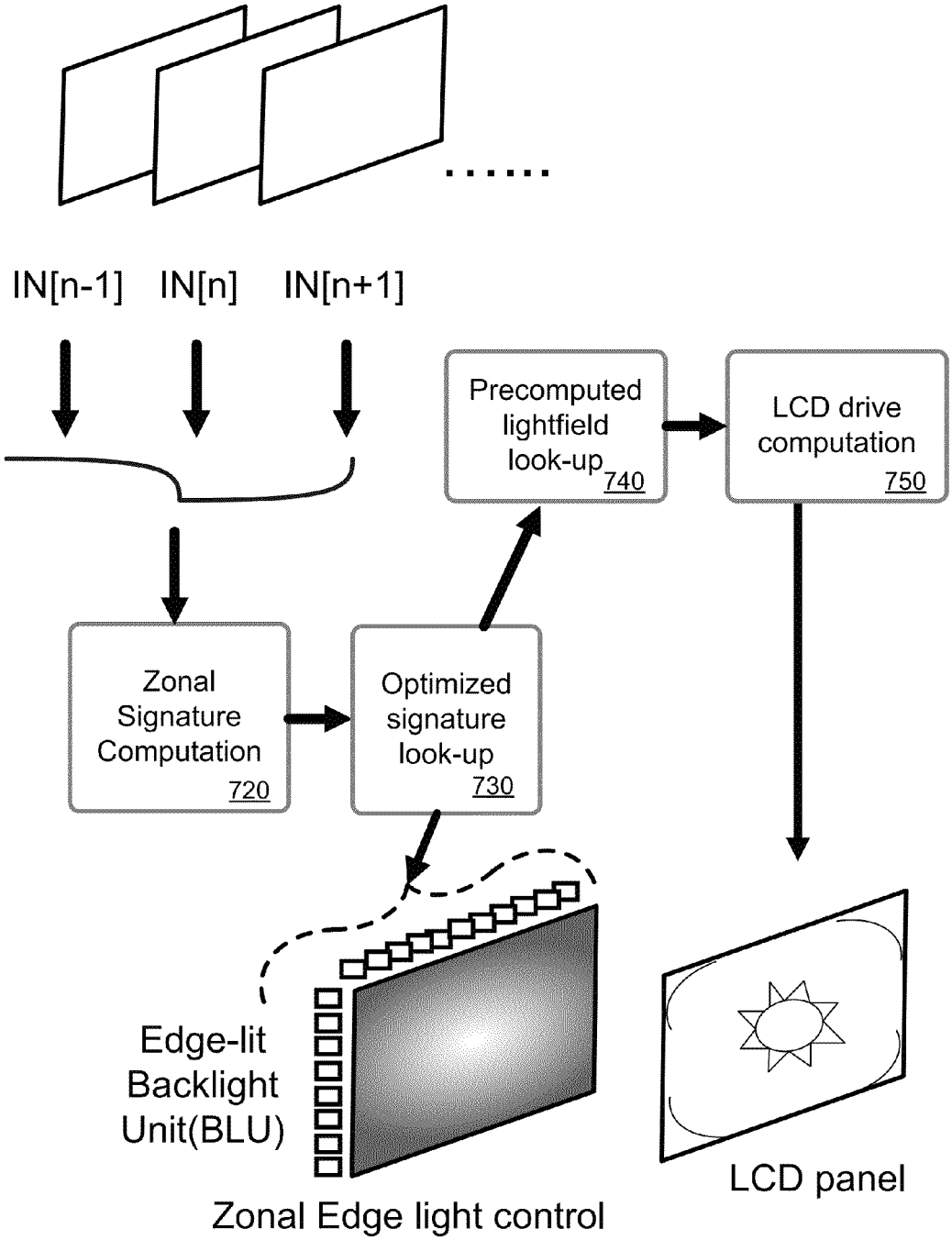
FIG. 7 is a drawing that illustrates an embodiment for faster computation of the edge lit LED zonal controls and the LCD pixel drives.

FIG. 7 is a drawing that illustrates an embodiment for faster computation of the edge lit LED zonal controls and the LCD pixel drives. By analyzing the incoming input video frames (pre buffers, IN[n−k], and look ahead pixel buffers, IN[n+k]), we can compute a zonal LED drive signature (Zonal Signature Computation device 720) that may be optimized for the power saving on the zonal drive controllers. The signature provides necessary zonal control to produce a desirable backlight for the image/frame to be displayed.

Since most dual modulation systems have a backlight system that moves (changes) slower than the LCD pixels, to reduce visible artifacts in source modulation (like haloing, walking LEDs, etc), the present invention may include use of a moving average of the zonal signatures over a definite time interval and/or their differential (for example: S(n)−S(n−1)) to look up the closest match to the simplified power optimized zonal drive configuration. Such moving averages may be computed or used to optimize the signature and may be performed, for example, via a look-up (e.g., Optimized signature look-up 730). This computed zonal control (or signature/optimized signature) is used to control the edge-light modulators. The light fields for these simplified drive configurations may be pre-computed and stored in memory of the system (and, for example, looked up via Pre-computed Light-field look-up device 740) and lead to simplified LCD drive calculations using equation (5) (e.g., via LCD drive computation device 750).

The present invention also includes using zonal control to compensate for other optical elements placed in the light processing path for multi-modulated display systems.

Figure 8:
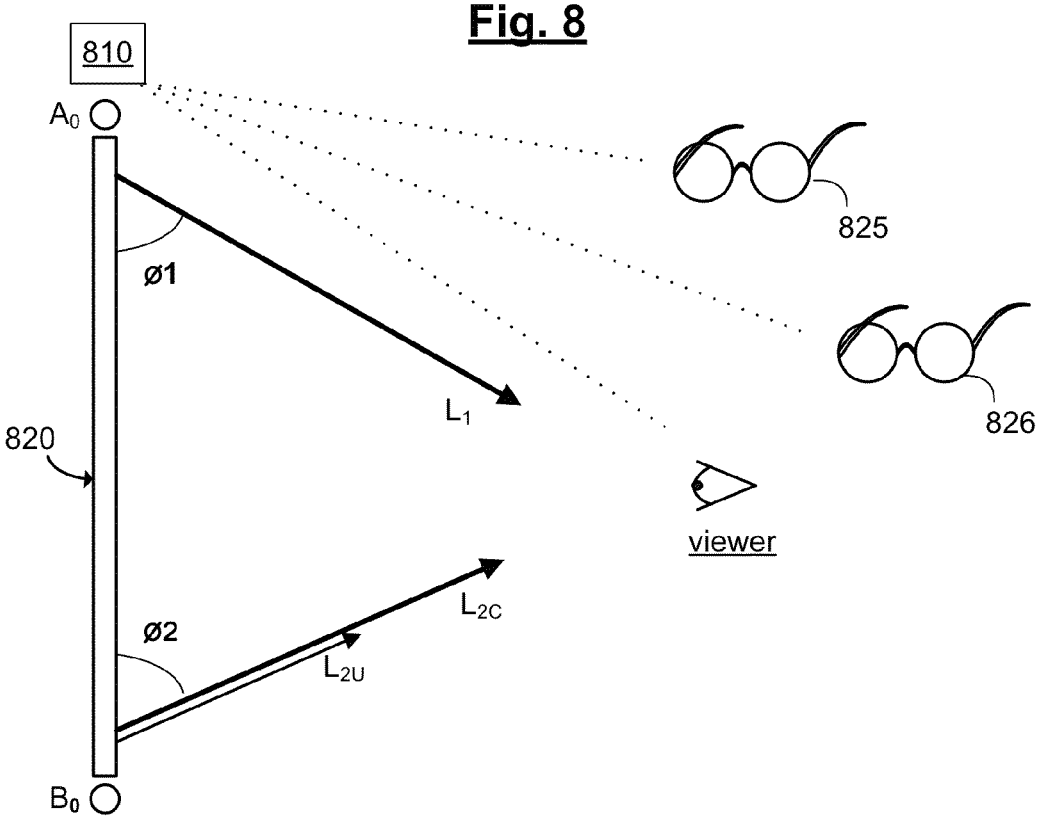
FIG. 8 is a drawing illustrating illumination differences based on viewing angle and compensation according to an embodiment of the present invention.
Figure 8:
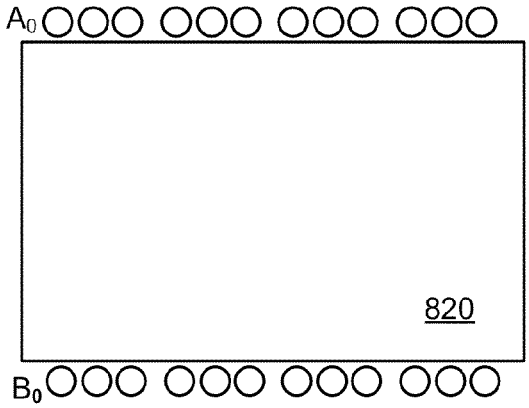

LCD technology has different transmission properties relative to viewing angles. The present invention includes the use of these light modulating techniques to compensate or enhance these properties. For example, as shown in FIG. 8, LCD viewing angles may be inherently brighter (or varying according to another parameter/parameters of light) when viewing at a particular angle. The viewing angle of greatest brightness may differ based on design. The invention includes a head/eye tracking device 810, which calculates a viewing angle of a viewer and then feeds the viewing angle to a processing device which determines a backlighting implementation that reduces or compensates for greater or lesser brightness relative to the viewer's viewing angle.

For example, all other items being equal, if the viewing angle results in brighter pixels at a top of the display, then the zones of lighting in the backlight are configured to produce brighter zones at the bottom of the display, thereby providing a weighted backlight that produces a more "uniform" illumination to the viewer. "Uniform, because the technique may be applied to globally illuminated displays (in which a non globally non-uniform backlight may be produced to provide uniform illumination to the viewer) and/or locally dimmed displays where the non-uniformity imposed on the backlight applies to an already locally dimmed backlight and which ultimately produces a high contrast image being viewed that is compensated for viewing angle related brightness changes.

In the illustrated example, the natural tendency of a particular example display is shown. All other items being equal, Light L1, having an angle $\phi$1 to viewer, has an inherent emitted brightness/intensity/chromaticity from a display panel 820. Light $L_{2U}$ ($L_2$ uncompensated), having an angle $\phi$2 to viewer, has an inherent emitted brightness/intensity/chromaticity from a display panel 820 that is lower than L1. After compensation (in this base a brightening of bottom edge light sources starting with zone B0), a brightness of $L_{2U}$ is increased to $L_{2C}$ ($L_2$ compensated).

The inherent brightness/intensity/chromaticity could be lower, higher, vary from side-to-side, or be illustrated by pattern emitted toward the viewer. Regardless of the pattern (e.g., repeating patterns that may on an auto-stereoscopic display), the invention includes providing a backlight pattern that compensates for "inherent" differences in the parameters of what would otherwise be an equivalent light emitted from the display toward the viewer. The compensation (or differences) may come in the form of brightness, color, color gamut, saturation, or other parameters of light which are then compensated by increasing, decreasing or otherwise altering the backlight (e.g., altering the parameters of light in one or more zones of the backlight) to provide the compensation.

The present invention includes recognizing viewing angles that cannot be properly compensated or would have little if any beneficial effect from available compensation, and/or the recognition of multiple viewers that may alter the preferred illumination scheme, adapting to multiple viewers to provide better compensation for each viewer, and includes determining when the illumination compensation should be turned off if no net advantage can be realized (e.g., too many viewers to provide effective compensation, providing some compensation for viewers at a most affected viewing angle without making other viewing angles worse than the viewing angle being corrected for, recognizing a most viewed viewing angle and compensating mostly for the most viewed angle (e.g., three viewers in close proximity and one viewer at an oblique angle—generally compensating for the three viewers in close proximity and disregarding the oblique angle viewer that cannot be helped without degrading the majority of viewers, recognizing motion and not compensating unless a viewer is essentially in a viewing position (e.g., little or no motion) (and not compensating until the viewing position is established for that viewer), and recognizing if a viewer is far enough from the display that compensation is not necessary).

In one embodiment, the invention includes a display having a menu option that allows a viewer/user to turn off head tracking/illumination compensation, and/or an option to continue head tracking illumination for a preferred viewer when multiple viewers at different locations might otherwise make illumination compensation less desirable. In one embodiment, the head tracking is integrated and/or operates in conjunction with a pair of glasses (e.g., 3D glasses having a locating device/emitter that operates in conjunction with head tracking device 810).

In another embodiment, the compensation varies depending on a view being displayed. In one embodiment glasses are used to differentiate views displayed to different viewers. The views may be differentiated based on, for example, spectral separation, polarization, or time division multiplexing (e.g., active glasses). The different views may be different video programs or movies playing simultaneously, or may be gaming between multiple players (e.g., player 1 view and player 2 view). Compensation is adjusted to a tracked position of viewer 1 or player 1 separately from that of viewer 2 or player 2 (e.g., player 1's view is illuminated with a first illumination compensation customized to player 1's location/angle when player 1's view is flashed on the LCD panel/display, and player 2's view is illuminated with a second compensated illumination customized to player 2's location/angle when player 2's view is flashed on the LCD panel/display).

In one embodiment, Player 1 wears glasses 825 which has lenses including filters that are either spectrally bandpassed, polarized, time multiplexed, or uses other separation technology differently than glasses 826 worn by player 2. The glasses may include RFID, radio transmitters, bar codes, or other mechanism(s) that are utilized by or in conjunction with head tracker 810 to allow viewing angles to be determined. The determined angles are then utilized to implement a compensation illumination algorithm that is, for example, used to increase of decrease globally of locally modulated backlight energization signals in a manner that compensates for illumination (or other property) differences related to the viewing angle.

Various embodiments of the present invention may relate to one or more of the Enumerated Example Embodiments (EEEs) below, each of which are examples, and, as with any other related discussion provided above, should not be construed as limiting any claim or claims provided yet further below as they stand now or as later amended, replaced, or added. Likewise, these examples should not be considered as limiting with respect to any claim or claims of any related patents and/or patent applications (including any foreign or international counterpart applications and/or patents, divisionals, continuations, re-issues, etc.).

EXAMPLES

Enumerated Example Embodiment 1

EEE1

A display, comprising:

an array of light sources comprising a plurality of sets of the light sources;

a zonal controller configured to energize at least one of the sets of light sources; and a modulating panel;

wherein each set of light sources are configured to produce a zonal illumination on the modulating panel and the modulating panel is configured to further modulate the zonal illuminations in a manner to produce a desired image.

EEE2

The display according to claim 1, wherein the zonal illuminations are based on image data and the further modulation of the zonal illuminations are based on a light field simulation of the zonal illuminations and the image data.

EEE3

The display according to claim 2, wherein the light field simulation comprises a summation of individual zonal illuminations' effect on pixels of the modulating panel.

EEE4

The display according to claim 3, wherein the light filed simulation comprises an output tristimulus value for each pixel vector:

for each pixel vector r, the output tristimulus values can be computed as follows:

$$\begin{bmatrix} X(r) \\ Y(r) \\ Z(r) \end{bmatrix} = \sum_j \left( [P]_j \cdot PSF(r - r_j) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right) \quad (1)$$

where $X(r), Y(r), Z(r)$ are the tri-stimulus values target outputs in front of the display at a particular pixel position vector r;

$PSF(r-r_j)$ is the point spread function representing light from $j^{th}$ LED centered at pixel position $r_j$ shining through the pixel at position r;

$x_j$ is the desired light output from the $j^{th}$ LED;

$[P]_j$ is the tristimulus calibration matrix for the jth LED that the light from a particular tristimulus primary LED through a particular color LCD filter. For example, a system using R, G, B LEDs in the edgelit configuration, with R, G, B filters in the LCDs can be represented by a 3×3 calibration matrix;

$[X\ Y\ Z]_{j,min}$ represent the light leakage through the LCD (while turned off) due to $j^{th}$ LED at $r_j$ shining through the pixel at position r; and $P_R(r), P_G(r), P_B(r)$ are the linear color LCD drive values that we would compute to energize the pixels on the LCD panel;

solving for the linear LCD drive values as follows:

$$\begin{bmatrix} P_R(r) \\ P_G(r) \\ P_B(r) \end{bmatrix} = [T]^{-1} \left( \begin{bmatrix} X(r) \\ Y(r) \\ Z(r) \end{bmatrix} - \sum_j \left( \begin{bmatrix} X \\ Y \\ Z \end{bmatrix}_{j,min} \cdot PSF(r - r_j) \cdot x_j \right) \right) \quad (2)$$

where $$[T] = \sum_j [P_j] \cdot PSF(r - r_j) \cdot x_j$$

EEE5

The display according to claim 4, wherein each pixel vector rj comprises a representative pixel in a group of pixels.

EEE6

The display according to claim 4, wherein each pixel vector rj comprises an average of a group of pixels.

EEE7

The display according to claim 2, wherein the light field simulation comprises a summation of individual zonal illuminations' effect and reflections' effect on pixels of the modulating panel.

EEE8

The display according to claim 7, wherein the light field simulation comprises:

In an edge-lit system, we would need account for the reflectance off the different surround surfaces. For each pixel vector r, the output tri-stimulus values can be computed as follows:

$$\begin{bmatrix} X(r) \\ Y(r) \\ Z(r) \end{bmatrix} = \sum_j \left( [P]_j \cdot PSF(r - r_j) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right) + \sum_j \left( [P]_j \cdot PSF(r - r_j) \cdot x_j \cdot R_j(r - r_j) \cdot \begin{bmatrix} P_R(r) \\ P_G(r) \\ P_B(r) \end{bmatrix} \right) \quad (4)$$

This can be reduced to:

$$\begin{bmatrix} X(r) \\ Y(r) \\ Z(r) \end{bmatrix} = \sum_j \left( [P]_j \cdot PSF(r - r_j) \cdot (1 + R_j(r - r_j)) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right) \quad (5)$$

where

X(r), Y(r), Z(r) are the tri-stimulus values target outputs in front of the display at a particular pixel position vector r;

$PSF(r-r_j)$ is the point spread function representing light from $j^{th}$ LED centered at pixel position $r_j$ shining through the pixel at position r;

$x_j$ is the desired light output from the $j^{th}$ LED;

$[P]_j$ is the tristimulus calibration matrix for the jth LED that the light from a particular tristimulus primary LED through a particular color LCD filter. For example, a system using R, G, B LEDs in the edgelit configuration, with R, G, B filters in the LCDs can be represented by a 3×3 calibration matrix;

$[X\ Y\ Z]_{j,min}$ represent the light leakage through the LCD (while turned off) due to $j^{th}$ LED at $r_j$ shining through the pixel at position r;

$R_j(r-r_j)$ is the spatial reflectivity spread function (SRSF) representing light from the $j^{th}$ LED centered at position $r_j$ shining through the pixel at position r; and $P_R(r)$, $P_G(r)$, $P_B(r)$ are the linear color LCD drive values that we would compute to energize the pixels on the LCD panel.

EEE9

The display according to claim 1, further comprising a light pipe having varying light emission properties.

EEE10

The display according to claim 1, further comprising a light pipe positioned to be fed by at least one of the light sources and emit light toward the modulating panel; and a reflective backing configured to reflect light from the at least one light source toward the modulating panel.

EEE11

The display according to claim 1, further comprising a diffuser configured to collect light from the light sources producing light rays in a direction more parallel to a plane of the diffuser and to emit light that is more perpendicular to the plane of the diffuser.

EEE12

The display according to claim 1, further comprising a modulating panel controller configured to energize the modulating panel according to a light field simulation and image data from a desired image, wherein the light field simulation accounts for light properties including brightness at at least one pixel of the modulating panel based on a summation of a plurality of zonal illuminations incident thereon.

EEE13

The display according to claim 12, wherein the lighting sources comprise LEDs.

EEE14

The display according to claim 12, wherein the sets of lighting sources comprise LEDs with different colors.

EEE15

The display according to claim 1, wherein the sets of lighting sources comprise red, green, and blue light emissions.

EEE16

The display according to claim 1, wherein at least two of the sets of light sources are configured to produce light emissions of mutually exclusive wavelengths each set including red, green, and blue wavelengths.

EEE17

The display according to claim 1, wherein the zonal illuminations comprise superimposed light from multiple light sources.

EEE18

The display according to claim 1, wherein the light sources are arranged on opposing edges of the display.

EEE19

The display according to claim 1, wherein the light sources are arranged on all edges of the display.

EEE20

The display according to claim 19, wherein the zonal illuminations are configured to produce a locally dimmed backlight for the modulation panel.

EEE21

The display according to claim 1, wherein the modulating panel comprises two LCD panels.

EEE22

The display according to claim 21, wherein one of the modulating panels has no color filters.

EEE23

A method, comprising the steps of:

receiving an image signal;

energizing a backlight according to at least one of illumination and color levels contained in the image signal in a manner to produce a plurality of zones of illumination configured to illuminate a modulating panel;

calculating a light field simulation based on the zones of illumination; and energizing the modulating panel based on the light filed simulation and the image signal.

EEE24

The method according to claim 23, wherein the light field simulation comprises a summation of a plurality of the zones of illumination effects at each pixel or at groups of pixels of the modulating panel.

EEE25

The method according to claim 24, wherein the light filed simulation comprises at least one of For each pixel vector r, the output tristimulus values can be computed as follows:

$$\begin{bmatrix} X(r) \\ Y(r) \\ Z(r) \end{bmatrix} = \sum_j \left( [P]_j \cdot PSF(r - r_j) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right) \quad (1)$$

where

X(r), Y(r), Z(r) are the tri-stimulus values target outputs in front of the display at a particular pixel position vector r;

PSF(r−$r_j$) is the point spread function representing light from $j^{th}$ LED centered at pixel position $r_j$ shining through the pixel at position r;

$x_j$ is the desired light output from the $j^{th}$ LED;

$[P]_j$ is the tristimulus calibration matrix for the jth LED that the light from a particular tristimulus primary LED through a particular color LCD filter. For example, a system using R, G, B LEDs in the edgelit configuration, with R, G, B filters in the LCDs can be represented by a 3×3 calibration matrix;

$[X\ Y\ Z]_{j,min}$ represent the light leakage through the LCD (while turned off) due to $j^{th}$ LED at $r_j$ shining through the pixel at position r; and $P_R(r)$, $P_G(r)$, $P_B(r)$ are the linear color LCD drive values that we would compute to energize the pixels on the LCD panel;

solving for the linear LCD drive values as follows:

$$\begin{bmatrix} P_R(r) \\ P_G(r) \\ P_B(r) \end{bmatrix} = [T]^{-1} \left( \begin{bmatrix} X(r) \\ Y(r) \\ Z(r) \end{bmatrix} - \sum_j \left( \begin{bmatrix} X \\ Y \\ Z \end{bmatrix}_{j,min} \cdot PSF(r - r_j) \cdot x_j \right) \right) \quad (2)$$

where $$[T] = \sum_j [P_j] \cdot PSF(r - r_j) \cdot x_j$$

and in an edge-lit system, accounting for the reflectance off the different surround surfaces, for each pixel vector r, the output tri-stimulus values can be computed as follows:

$$\begin{bmatrix} X(r) \\ Y(r) \\ Z(r) \end{bmatrix} = \sum_j \left( |P|_j \cdot PSF(r - r_j) \cdot x_j \cdot \begin{bmatrix} P_R(r) \\ P_G(r) \\ P_B(r) \end{bmatrix} \right) + \quad (4)$$

-continued $$\sum_j \left( \begin{bmatrix} X \\ Y \\ Z \end{bmatrix}_{j,min} \cdot PSF(r - r_j) \cdot x_j \right) + \sum_j \left( [P]_j \cdot PSF(r - r_j) \cdot x_j \cdot R_j(r - r_j) \cdot \begin{bmatrix} P_R(r) \\ P_G(r) \\ P_B(r) \end{bmatrix} \right)$$

which may be reduced to:

$$\begin{bmatrix} X(r) \\ Y(r) \\ Z(r) \end{bmatrix} = \sum_j \left( [P]_j \cdot PSF(r - r_j) \cdot (1 + R_j(r - r_j)) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right)$$

where:

X(r), Y(r), Z(r) are the tri-stimulus values target outputs in front of the display at a particular pixel position vector r;

PSF(r−$r_j$) is the point spread function representing light from $j^{th}$ LED centered at pixel position $r_j$ shining through the pixel at position r;

$x_j$ is the desired light output from the $j^{th}$ LED;

$[P]_j$ is the tristimulus calibration matrix for the jth LED that the light from a particular tristimulus primary LED through a particular color LCD filter. For example, a system using R, G, B LEDs in the edgelit configuration, with R, G, B filters in the LCDs can be represented by a 3×3 calibration matrix;

$[X\ Y\ Z]_{j,min}$ represent the light leakage through the LCD (while turned off) due to $j^{th}$ LED at $r_j$ shining through the pixel at position r;

$R_j(r-r_j)$ is the spatial reflectivity spread function (SRSF) representing light from the $j^{th}$ LED centered at position $r_j$ shining through the pixel at position r;

$P_R(r)$, $P_G(r)$, $P_B(r)$ are the linear color LCD drive values that we would compute to energize the pixels on the LCD panel; and in the groups of pixels case, a similar calculation based on the pixel groups instead of individual pixels.

EEE26

A method for fast multi-modulation computation, comprising the steps of:

Analyzing a set of incoming video frames;

Determining a zonal backlight drive signature comprising zonal control of a backlight to produce a backlight for at least one of the frames;

estimating a lightfield to be produced upon application of a drive signal to the backlight according to the computed signature;

computing a downstream modulator drive signal based on at least one of the video frames and the estimated lightfield; and applying the signature to the backlight and the downstream modulator drive signal to a downstream modulator.

EEE27

The method according to claim 26, wherein the downstream modulator comprises a multi-panel multi-modulator.

EEE28

The method according to claim 26, further comprising the step of optimizing the signature for the power saving on the zonal drive controllers.

EEE29

The method according to claim 26, wherein the backlight comprises an edge lit backlight.

EEE30

The method according to claim 26, wherein the signature is pre-computed and retrieved from a database of signatures.

EEE31

The method according to claim 26, wherein the signature is optimized using a moving average of the zonal signatures over a time interval.

In describing preferred embodiments of the present invention illustrated in the drawings, specific terminology is employed for the sake of clarity. However, the present invention is not intended to be limited to the specific terminology so selected, and it is to be understood that each specific element includes all technical equivalents which operate in a similar manner. For example, when describing a lighting source such as an LED, any other equivalent device, such as OLEDs, carbon nanotube based light emitters, fluorescents, incandescent, or other devices having an equivalent function or capability, whether or not listed herein, may be substituted therewith. Furthermore, the inventors recognize that newly developed technologies not now known may also be substituted for the described parts and still not depart from the scope of the present invention. All other described items, including, but not limited to modulating panels, controllers, reflectors, diffusers, collimators, etc should also be considered in light of any and all available equivalents.

Portions of the present invention may be conveniently implemented using a conventional general purpose or a specialized digital computer or microprocessor programmed according to the teachings of the present disclosure, as will be apparent to those skilled in the computer art.

Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art based on the present disclosure.

The present invention includes a computer program product which is a storage medium (media) having instructions stored thereon/in which can be used to control, or cause, a computer to perform any of the processes of the present invention. The storage medium can include, but is not limited to, any type of disk including floppy disks, mini disks (MD's), optical discs, DVD, HD-DVD, Blue-ray, CD-ROMS, CD or DVD RW+/−, micro-drive, and magneto-optical disks, ROMs, RAMs, EPROMs, EEPROMs, DRAMs, VRAMs, flash memory devices (including flash cards, memory sticks), magnetic or optical cards, SIM cards, MEMS, nanosystems (including molecular memory ICs), RAID devices, remote data storage/archive/warehousing, or any type of media or device suitable for storing instructions and/or data.

Stored on any one of the computer readable medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, operating systems, and user applications (e.g., user applications to adjust capabilities or features of the display, such as color, brightness, and contrast, etc.). Ultimately, such computer readable media further includes software for performing the present invention, as described above.

Included in the programming (software) of the general/specialized computer or microprocessor are software modules for implementing the teachings of the present invention, including, but not limited to, determining light field simulations, determining backlighting levels based on image data, determining modulation parameters for spatial light modulator(s) based on any of a light field, light field simulation and image data and the display, storage, or communication of results according to the processes of the present invention.

The present invention may suitably comprise, consist of, or consist essentially of, any of element (the various parts or features of the invention) and their equivalents as described herein. Further, the present invention illustratively disclosed herein may be practiced in the absence of any element, whether or not specifically disclosed herein. Obviously, numerous modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. A display, comprising:

an array of light sources comprising a plurality of sets of the light sources;

a zonal controller configured to energize at least one of the sets of light sources; and a modulating panel;

wherein:

each set of light sources are configured to produce a zonal illumination on the modulating panel and the modulating panel is configured to further modulate the zonal illuminations in a manner to produce a desired image;

the zonal illuminations are based on image data and the further modulation of the zonal illuminations are based on a light field simulation of the zonal illuminations and the image data;

the light field simulation comprises a summation of individual zonal illuminations' effect on pixels of the modulating panel; and the light field simulation comprises an output tristimulus value for each pixel vector r, comprising:

$$\begin{bmatrix} X(r) \\ Y(r) \\ Z(r) \end{bmatrix} = \sum_j \left( [P]_j \cdot PSF(r - r_j) \cdot x_j \cdot \begin{bmatrix} P_R(r) \\ P_G(r) \\ P_B(r) \end{bmatrix} \right) + \quad (1)$$

-continued $$\sum_j \left( \begin{bmatrix} X \\ Y \\ Z \end{bmatrix}_{j,min} \cdot PSF(r - r_j) \cdot x_j \right)$$

where:

X(r), Y(r), and Z(r) comprise tri-stimulus values target outputs in front of the display at a particular pixel position vector r;

PSF(r−$r_j$) comprises a point spread function representing light from a $j^{th}$ LED centered at pixel position $r_j$ shining through a pixel at position r;

$x_j$ comprises a representation of a desired light output from the $j^{th}$ LED;

$[P]_j$ comprises a tristimulus calibration matrix for the jth LED comprising light from a particular tristimulus primary LED through a particular color LCD filter;

$[X\ Y\ Z]_{j,min}$ comprises a representation of light leakage through the LCD while turned off due to $j^{th}$ LED at $r_j$ shining through a pixel at position r; and $P_R(r)$, $P_G(r)$, $P_B(r)$ comprise linear color LCD drive values that energize pixels on the LCD panel; and wherein the linear LCD drive values comprise:

$$\begin{bmatrix} P_R(r) \\ P_G(r) \\ P_B(r) \end{bmatrix} = [T]^{-1} \left( \begin{bmatrix} X(r) \\ Y(r) \\ Z(r) \end{bmatrix} - \sum_j \left( \begin{bmatrix} X \\ Y \\ Z \end{bmatrix}_{j,min} \cdot PSF(r - r_j) \cdot x_j \right) \right) \tag{2}$$

where $$[T] = \sum_j [P_j] \cdot PSF(r - r_j) \cdot x_j.$$

2. The display according to claim 1, wherein each pixel vector rj comprises a representative pixel in a group of pixels.

3. The display according to claim 1, wherein each pixel vector rj comprises an average of a group of pixels.

4. The display according to claim 1, wherein the light sources are arranged at an edge of the display.

5. A display, comprising:

an array of light sources comprising a plurality of sets of the light sources;

a zonal controller configured to energize at least one of the sets of light sources; and a modulating panel;

wherein:

each set of light sources are configured to produce a zonal illumination on the modulating panel and the modulating panel is configured to further modulate the zonal illuminations in a manner to produce a desired image;

the zonal illuminations are based on image data and the further modulation of the zonal illuminations are based on a light field simulation of the zonal illuminations and the image data;

the light field simulation comprises a summation of individual zonal illuminations' effect and reflections' effect on pixels of the modulating panel; and the light field simulation comprises:

in an edge-lit display that accounts for reflectances, for each pixel vector r, the output tri-stimulus values can be computed as follows:

$$\begin{bmatrix} X(r) \\ Y(r) \\ Z(r) \end{bmatrix} = \sum_j \left( [P]_j \cdot PSF(r - r_j) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right) + \sum_j \left( [P]_j \cdot PSF(r - r_j) \cdot x_j \cdot R_j(r - r_j) \cdot \begin{bmatrix} P_R(r) \\ P_G(r) \\ P_B(r) \end{bmatrix} \right) \tag{4}$$

And which may be reduced to:

$$\begin{bmatrix} X(r) \\ Y(r) \\ Z(r) \end{bmatrix} = \sum_j \left( [P]_j \cdot PSF(r - r_j) \cdot (1 + R_j(r - r_j)) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right) \tag{5}$$

where:

X(r), Y(r), Z(r) are the tri-stimulus values target outputs in front of the display at a particular pixel position vector r;

PSF(r−$r_j$) is the point spread function representing light from a $j^{th}$ LED centered at pixel position $r_j$ shining through the pixel at position r;

$x_j$ is the desired light output from the $j^{th}$ LED;

$[P]_j$ is the tristimulus calibration matrix for the jth LED that the light from a particular tristimulus primary LED through a particular color LCD filter;

$[X\ Y\ Z]_{j,min}$ represents light leakage through the LCD while turned off due to $j^{th}$ LED at $r_j$ shining through a pixel at position r;

$R_j(r-r_j)$ comprises a spatial reflectivity spread function representing light from the $j^{th}$ LED centered at position $r_j$ shining through the pixel at position r; and $P_R(r)$, $P_G(r)$, $P_B(r)$ are linear color LCD drive values computed to energize pixels on the LCD panel.

6. The display according to claim 5, further comprising a light pipe having varying light emission properties.

7. The display according to claim 5, further comprising a light pipe positioned to be fed by at least one of the light sources and emit light toward the modulating panel; and a reflective backing configured to reflect light from the at least one light source toward the modulating panel.

8. The display according to claim 5, further comprising a diffuser configured to collect light from the light sources producing light rays in a direction more parallel to a plane of the diffuser and to emit light that is more perpendicular to the plane of the diffuser.

9. The display according to claim 5, further comprising a modulating panel controller configured to energize the modulating panel according to a light field simulation and image data from a desired image, wherein the light field simulation accounts for light properties including brightness at at least one pixel of the modulating panel based on a summation of a plurality of zonal illuminations incident thereon.

10. The display according to claim 9, wherein the lighting sources comprise LEDs.

11. The display according to claim 9, wherein the sets of lighting sources comprise LEDs with different colors.

12. The display according to claim 5, wherein the sets of lighting sources comprise red, green, and blue light emissions.

13. The display according to claim 5, wherein at least two of the sets of light sources are configured to produce light emissions of mutually exclusive wavelengths each set including red, green, and blue wavelengths.

14. The display according to claim 5, wherein the zonal illuminations comprise superimposed light from multiple light sources.

15. The display according to claim 5, wherein the light sources are arranged on opposing edges of the display.

16. The display according to claim 5, wherein the light sources are arranged on all edges of the display.

17. The display according to claim 5, wherein the zonal illuminations are configured to produce a locally dimmed backlight for the modulation panel.

18. The display according to claim 5, wherein the modulating panel comprises two LCD panels.

19. The display according to claim 18, wherein one of the modulating panels has no color filters.

20. The display according to claim 5, wherein the display comprises an edge lit locally dimmed display.

21. A method, comprising the steps of:

receiving an image signal;

energizing a backlight according to at least one of illumination and color levels contained in the image signal in a manner to produce a plurality of zones of illumination configured to illuminate a modulating panel;

calculating a light field simulation based on the zones of illumination; and energizing the modulating panel based on the light filed simulation and the image signal;

wherein the light field simulation comprises a summation of a plurality of the zones of illumination effects at each pixel or at groups of pixels of the modulating panel;

wherein the light filed simulation comprises at least one of:

(A) for each pixel vector r, output tristimulus values comprising:

$$\begin{bmatrix} X(r) \\ Y(r) \\ Z(r) \end{bmatrix} = \sum_j \left( [P]_j \cdot PSF(r - r_j) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right) \quad (1)$$

where

X(r), Y(r), Z(r) comprise tri-stimulus values target outputs in front of the display at a particular pixel position vector r;

PSF(r−$r_j$) comprises point spread function representing light from $j^{th}$ LED centered at pixel position $r_j$ shining through the pixel at position r;

$x_j$ comprises desired light output from a $j^{th}$ LED;

$[P]_j$ is the tristimulus calibration matrix for the jth LED that the light from a particular tristimulus primary LED through a particular color LCD filter;

$[X\ Y\ Z]_{j,min}$ comprises a representation of light leakage through the LCD while turned off due to $j^{th}$ LED at $r_j$ shining through the pixel at position r; and $P_R(r)$, $P_G(r)$, $P_B(r)$ are the linear color LCD drive values that we would compute to energize the pixels on the LCD panel; and (B) in an edge-lit system that accounts for reflectance off surround surfaces, for each pixel vector r, the output tri-stimulus values comprise:

$$\begin{bmatrix} X(r) \\ Y(r) \\ Z(r) \end{bmatrix} = \sum_j \left( [P]_j \cdot PSF(r - r_j) \cdot (1 + R_j(r - r_j)) \cdot x_j \cdot \begin{bmatrix} P_R(r) \\ P_G(r) \\ P_B(r) \end{bmatrix} \right) + \sum_j \left( \begin{bmatrix} X \\ Y \\ Z \end{bmatrix}_{j,min} \cdot PSF(r - r_j) \cdot x_j \right)$$

where

X(r), Y(r), Z(r) comprise tri-stimulus values target outputs in front of the display at a particular pixel position vector r;

PSF(r−$r_j$) comprises a point spread function representing light from $j^{th}$ LED centered at pixel position $r_j$ shining through a pixel at position r;

$x_j$ comprises a desired light output from the $j^{th}$ LED;

$[P]_j$ comprises a tristimulus calibration matrix for the jth LED that the light from a particular tristimulus primary LED through a particular color LCD filter;

$[X\ Y\ Z]_{j,min}$ comprises a representation of light leakage through the LCD while turned off due to $j^{th}$ LED at $r_j$ shining through the pixel at position r;

$R_j(r-r_j)$ is the spatial reflectivity spread function representing light from the $j^{th}$ LED centered at position $r_j$ shining through a pixel at position r; and $P_R(r)$, $P_G(r)$, $P_B(r)$ are the linear color LCD drive values that we would compute to energize the pixels on the LCD panel; and in either alternative (A) or (B), in a groups of pixels case, a similar calculation based on the pixel groups instead of individual pixels.

22. The method according to claim 21, wherein the backlight illuminates the modulating panel from an edge.

23. A method for fast multi-modulation computation, comprising the steps of:

analyzing a set of incoming video frames;

determining a zonal backlight drive signature comprising zonal control and a lightfield of a backlight to produce a backlight for at least one of the frames;

estimating a lightfield to be produced upon application of a drive signal to the backlight according to the computed signature;

computing a downstream modulator drive signal based on at least one of the video frames and the estimated lightfield; and applying the signature to the backlight and the downstream modulator drive signal to a downstream modulator;

wherein the estimated lightfield comprises a summation of individual zonal illuminations' effect and reflections' effect on pixels of the modulating panel, computed as:

$$\begin{bmatrix} X(r) \\ Y(r) \\ Z(r) \end{bmatrix} = \sum_j \left( [P]_j \cdot PSF(r - r_j) \cdot (1 + R_j(r - r_j)) \cdot x_j \cdot \begin{bmatrix} P_R(r) \\ P_G(r) \\ P_B(r) \end{bmatrix} \right) +$$

-continued $$\sum_j \left( \begin{bmatrix} X \\ Y \\ Z \end{bmatrix}_{j,min} \cdot PSF(r - r_j) \cdot x_j \right)$$

where:

X(r), Y(r), Z(r) are tri-stimulus values target outputs in front of the display at a particular pixel position vector r;

$PSF(r-r_j)$ is the point spread function representing light from a $j^{th}$ LED centered at pixel position $r_j$ shining through the pixel at position r;

$x_j$ is the desired light output from the $j^{th}$ LED;

$[P]_j$ is the tristimulus calibration matrix for the jth LED that the light from a particular tristimulus primary LED through a particular color LCD filter;

$[X\ Y\ Z]_{j,min}$ represents light leakage through the LCD while turned off due to $j^{th}$ LED at $r_j$ shining through a pixel at position r;

$R_j(r-r_j)$ comprises a spatial reflectivity spread function representing light from the $j^{th}$ LED centered at position $r_j$ shining through the pixel at position r; and $P_R(r)$, $P_G(r)$, $P_B(r)$ are linear color LCD drive values computed to energize pixels on the LCD panel.

24. The method according to claim 23, wherein the downstream modulator comprises a multi-panel multi-modulator.

25. The method according to claim 23, further comprising the step of optimizing the signature for the power saving on the zonal drive controllers.

26. The method according to claim 23, wherein the backlight comprises an edge lit backlight.

27. The method according to claim 23, wherein the signature is pre-computed and retrieved from a database of signatures.

28. The method according to claim 23, wherein the signature is optimized using a moving average of the zonal signatures over a time interval.

29. The method according to claim 23, wherein the zonal backlight drive signature is based on edge lit illumination of a device employing the method.

* * * * *